US005249873A

United States Patent [19]

Okunomiya et al.

[11] Patent Number: 5,249,873

[45] Date of Patent: Oct. 5, 1993

[54] METHOD AND APPARATUS FOR THERMAL TRANSFER RECORDING AND INK PAPER CASSETTE THEREFOR

[75] Inventors: Seiji Okunomiya, Katsuta; Masashi Yoshida, Nakaminato, both of Japan

[73] Assignee: Hitachi, Ltd., Tokyo, Japan

[21] Appl. No.: 906,422

[22] Filed: Jun. 30, 1992

[30] Foreign Application Priority Data

Jul. 5, 1991 [JP] Japan ..... 3-164803

[51] Int. Cl.[5] ..... B41J 2/32

[52] U.S. Cl. ..... 400/120; 346/76 PH; 400/208; 400/583.3; 400/624

[58] Field of Search ..... 400/207 E, 237 E, 583.3, 400/703, 208, 120, 237, 624, 76, 207, 708; 346/76 PH

[56] References Cited

U.S. PATENT DOCUMENTS

| | | | |
|---|---|---|---|
| 4,616,236 | 10/1986 | Watanabe et al. | 346/76 PH |
| 4,901,090 | 2/1990 | Ozawa et al. | 346/76 PH |
| 4,915,516 | 4/1990 | Shimizu et al. | 400/120 |
| 4,949,097 | 8/1990 | Imaseki | 346/76 PH |
| 5,064,301 | 11/1991 | Nakamura et al. | 400/120 |
| 5,085,529 | 2/1992 | McGourty et al. | 400/120 |

FOREIGN PATENT DOCUMENTS

| | | | |
|---|---|---|---|
| 0091081 | 5/1984 | Japan | 400/624 |
| 0257282 | 12/1985 | Japan | 400/207 E |
| 61-274971 | 5/1986 | Japan . | |
| 61-274978 | 5/1986 | Japan . | |
| 0209188 | 9/1986 | Japan | 400/207 E |
| 0292474 | 12/1987 | Japan | 400/207 E |
| 0120678 | 5/1988 | Japan | 400/207 E |
| 0125363 | 5/1988 | Japan | 400/624 |

*Primary Examiner*—Edgar S. Burr
*Assistant Examiner*—Christopher A. Bennett
*Attorney, Agent, or Firm*—Fay, Sharpe, Beall, Fagan, Minnich & McKee

[57] ABSTRACT

In a thermal transfer recording system, an ink paper cassette containing an ink paper having ink layers and an ink paper feed bobbin with the ink paper wound therearond, and further containing a take-up bobbin for taking up the ink paper fed from the feed bobbin, is used in conjunction with a recording paper, a platen roller, and a thermal head. The recording paper and the ink paper fed from the feed bobbin are disposed in a superimposed manner on the platen roller and are pressed toward the platen roller form the ink paper side and heated by the thermal head, thereby allowing ink to be transferred to the recording paper form the ink paper in accordance with information provided to the thermal head. A discrimination is made as to whether the ink paper cassette is a first ink paper cassette which contains a first ink paper having only ink layers, or a second ink paper cassette which contains a second ink paper having both a receiving layer and ink layers. If the ink paper cassette is judged to be the first ink paper cassette, a first recording paper having a receiving layer is selected, while if the ink paper cassette is judged to be the second ink paper cassette, a second recording paper not having a receiving layer is selected. Consequently, ink is transferred to the selected recording paper from the ink paper contained in the ink paper cassette.

8 Claims, 4 Drawing Sheets

METHOD AND APPARATUS FOR THERMAL TRANSFER RECORDING AND INK PAPER CASSETTE THEREFOR

BACKGROUND OF THE INVENTION

The present invention relates to a method and apparatus for thermal transfer recording to be used in a video printer or the like, for example. Particularly, the present invention is concerned with a method and apparatus for thermal transfer recording using an ink paper cassette which contains, a band-like ink paper, and which can change over from one operation mode to another according to the type of ink paper used.

As a method and apparatus for printing characters or pictures by thermal transfer recording using an ink paper cartridge with ink applied thereto, there are known those wherein the ink paper cartridge is provided with a shape discriminator or an optical discriminator to determine the type of the ink paper cartridge used, and control is effected, for example, to increase the amount of heat energy to be imparted to the ink in the case of using a sublimation dye ink as compared with the case where a wax-type ink is used, while taking into consideration the kind of ink such as wax-type or sublimation dye ink, the number of ink colors, or the order of ink colors, to obtain a desired print density or gradation characteristic. In this connection, reference is made, for example, to Japanese Patent Application Laid-Open Nos. 61-274971 and 61-274978.

SUMMARY OF THE INVENTION

According to the above prior art, however, conditions for printing are controlled to effect desired recordings in combinations between various inks and recording papers, each being provided with a predetermined receiving layer suitable for the various inks, and no consideration is given therein about a function to be exhibited at the time of printing a recording paper not having the predetermined receiving layer. For example, in the case of printing using a sublimation dye ink, it is necessary to provide on the recording paper side a receiving layer best suited for the transfer of the sublimation dye ink on the basis of the characteristics of the same ink, and it is necessary to use a recording paper which has been prepared specially in advance for the ink paper used. In the case where a high quality recording equal to that obtained by using such special recording paper is to be attained also for any other recording paper than the special recording paper, e.g. a postal card or ordinary paper, it is also necessary to form the receiving layer on the paper used in advance. More particularly, it is necessary to apply a liquid receiving layer uniformly to the paper, or to laminate a receiving layer which has been formed in the shape of a film, to the paper using a special laminator. In order for the user to perform this operation, a special device is required for this troublesome operation.

Accordingly, it is the object of the present invention to provide a thermal transfer recording method which is improved to overcome the above-mentioned problems.

The above object is attained by judging whether an ink paper cassette loaded to a printer is an ink paper cassette containing ink paper provided with only an ink layer, or an ink paper cassette provided with not only ink layers but also a receiving layer in front of the ink layers. In the former case, a special recording paper having a receiving layer formed beforehand is selected, and a conventional thermal transfer printing is performed. In the latter case, namely, in the case of the loaded ink paper cassette containing ink paper provided with not only ink layers but also a receiving layer, a recording paper with a receiving layer not formed yet is selected, and then a receiving layer is transferred onto the recording paper using a thermal head and a platen roller, followed by conventional printing. For determining the type of the paper contained in each ink paper cassette, there is provided on the ink paper cassette side a morphological discriminating portion such as a projection, a hole or a notch, or an optical discriminating portion such as a reflective sheet, which indicates the type of the ink paper contained in the cassette.

According to the present invention, moreover, in an ink paper cassette which contains an ink paper comprising a light transmitting base film and three-color ink layers of, for example, yellow, magenta and cyan applied successively onto the base film, the ink paper being wound round a pair of bobbins, a receiving layer is formed in a base film area ahead of the area applied with the ink layers.

When such an ink paper cassette is loaded to the thermal transfer recording apparatus of the present invention, the apparatus judges the type of the ink paper contained in the cassette and changes the printing mode according to the type of the ink paper, whereby even a recording paper not having a receiving layer can be printed at a predetermined high quality equal to the print quality of a recording paper having a receiving layer, without the necessity of using any special device and without requiring a troublesome operation.

According to a particular embodiment of the present invention, a discrimination mark is provided on a recording paper having a receiving layer. By reading such mark on the recording paper, coupled with information of the type of ink paper, it is made possible to prevent the occurrence of an error in selecting a suitable recording paper for printing.

BRIEF DESCRIPTION OF THE DRAWINGS

FIG. 2 shows a state in which the recording paper is being discharged from the platen roller;

FIG. 4(*b*) is a partial top view showing an example of an ink paper with both a receiving layer and ink layers applied thereto;

DETAILED DESCRIPTION OF THE PREFERRED EMBODIMENT

A thermal transfer recording apparatus according to an embodiment of the present invention will be described with reference to the accompanying drawings.

(1) Construction of the apparatus

Figure 1:
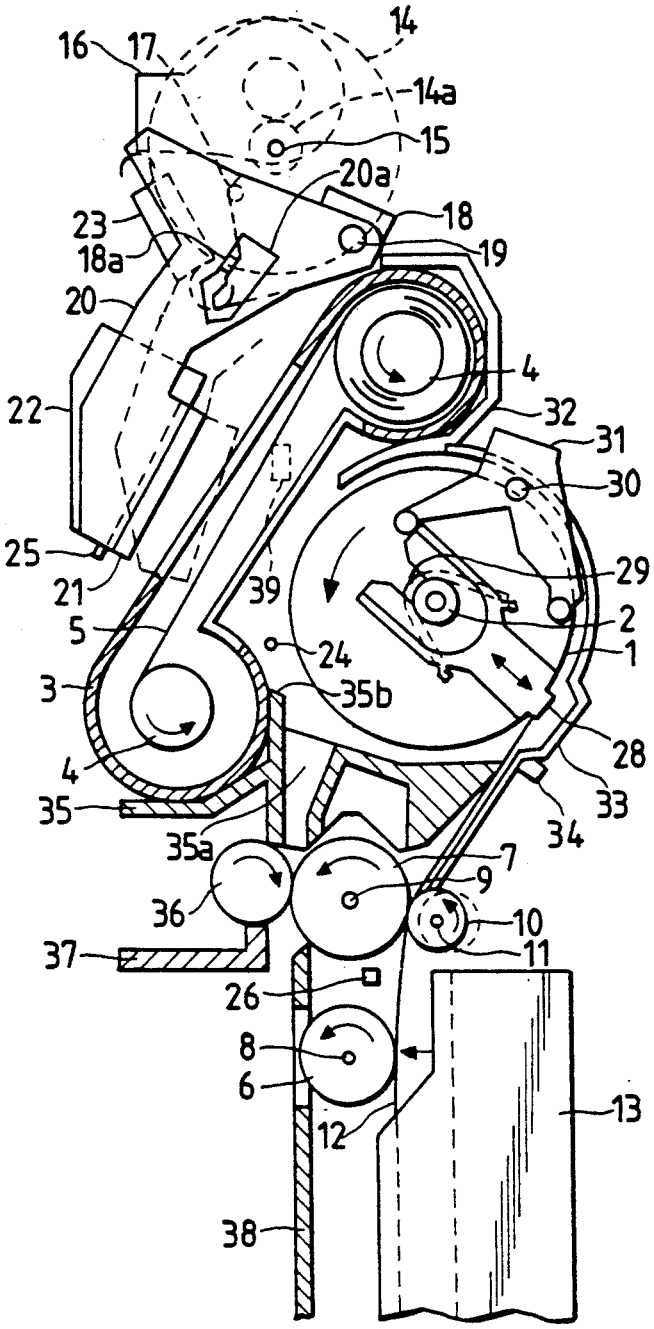
FIGS. 1 and 2 are each a front view of a thermal transfer recording apparatus embodying the present invention which carries out the thermal transfer recording method of the present invention, of which FIG. shows a state in which a recording paper is being fed to a platen roller

As shown in FIG. 1, a platen roller 1 is supported by a pair of chassis (not shown) rotatably through a shaft 2, and it is driven rotatively by means of a drive source, a drive circuit and a control circuit, which are not shown. In an ink paper cassette 3, ink paper 5 is wound round a pair of ink bobbins 4 rotatably. When loaded to the apparatus, the ink paper 5 is driven under a predetermined tension at a frictional rotating torque induced through a slip mechanism (not shown).

A pickup roller 6 and a feed roller 7 are supported by a pair of chassis (not shown) rotatably through shafts 8 and 9, respectively, and are each formed by stick-molding a cylindrical rubber material and driven rotatively in the counterclockwise direction by means of a drive source (not shown). A separating roller 10, which is supported rotatably through a shaft 11 as a rotating shaft, is formed by stick-molding a cylindrical rubber material and is constructed so that it can be brought into pressure contact with the feed roller 7 at a predetermined force and can be moved away from the same roller up to its dotted line position shown in FIG. 1. Further, the separating roller 10 is constructed to rotate counterclockwise at a predetermined frictional rotating torque through a slip mechanism (not shown) disposed on the shaft 11. The frictional rotating torque transmitted to the shaft 11 is set larger than a frictional force generated between recording papers 12 and smaller than a frictional force developed between the feed roller 7 and each recording paper 12 to prevent an overlapped feed of recording papers 12 into the apparatus.

Figure 5:
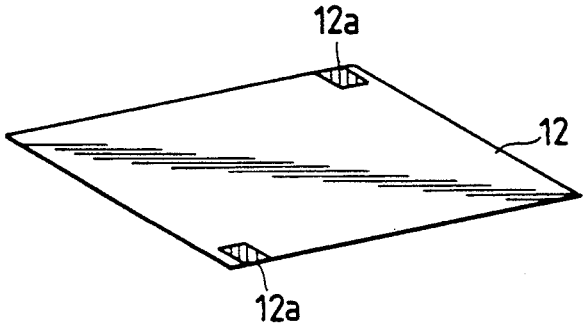
FIG. 5 is a perspective view showing an example of a recording paper.

Recording papers 12 stacked on a recording paper tray 13 with the respective printing faces facing down are each driven, at the time of paper feed, in the direction indicated by an arrow in FIG. 1 by means of a drive member (not shown) and brought into pressure contact with the pickup roller 6 under the action of a predetermined urging force. As shown in FIG. 5, discrimination marks 12*a* are provided on the back of each recording paper having a receiving layer formed thereon for the transfer of ink, and at the time of paper feed, the discrimination marks 12*a* are read by a paper marker sensor 26 disposed on a bracket (not shown). The recording paper tray 13 can hold two types of papers, one being a special recording paper having a receiving layer and the other an ordinary paper not having such receiving layer. From these recording papers, a suitable one can be selected automatically by reading the discrimination mark on the an ink paper cassettes loaded.

Conversely, the apparatus may be constructed in such a manner that the recording paper having a receiving layer is read on the basis of the discrimination marks 12*a* by means of the paper marker sensor 26, and then a special ink paper cassette 3 is selected in accordance with the discrimination signal provided from the sensor 26. In this case, however, the construction of the apparatus is complicated because it is required to permit setting of two types of ink paper cassettes, so from the standpoint of practical use it is desirable to adopt the former method of first reading the discrimination mark of each ink paper cassette and then selecting a suitable recording paper.

A cam gear 14 which determines an operating position of the apparatus is rotatably supported by a pin 15 implanted in a chassis (not shown), and a pinion portion 14*a* is in engagement with a rotary selector switch 16. The cam gear 14 and the selector switch 16 are each connected to a drive source and a drive circuit (neither shown), and switching is made from one position signal to another in the selector switch 16 according to operation modes to thereby rotate the cam gear 14 to a predetermined position.

In the surface of the cam gear 14 is formed a cam groove (not shown), and a pin 17 fitted in the cam groove is erected on an arm 18. Also erected on the arm 18 is a pin 19 extending through a pair of head arms 20 for pivotal movement of the arms, which arms are mounted to a chassis (not shown) pivotably about the pin 19. To the head arms 20 are fixed, with bolts, a thermal head 21 and heat radiation fins 22 for cooling (not shown). Further, between the head arms 20 and the arm 18 is stretched a head spring 23 for urging the thermal head 21 against the platen roller 1 with a predetermined certain force. When the urging force of the thermal head 21 is to be released, a portion 18*a* of the arm 18 and an opening 20*a* of the head arm 20 are brought into abutment with each other. The numeral 24 denotes a light emitting element for emitting light of a certain wavelength, and numeral 25 denotes a light receiving element for receiving the light, the light receiving element 25 being disposed at a front end of the thermal head 21, so that the light passes through the ink paper 5.

Figure 3:
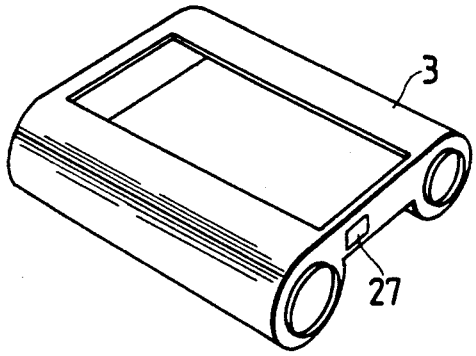
FIG. 3 is a perspective view showing an example of an ink paper cassette.
Figure 4A:
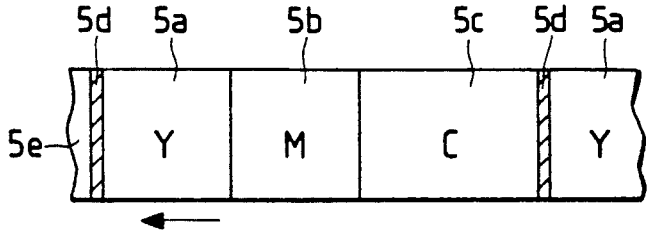
FIG. 4(*a*) is a partial top view showing an example of an ink paper with ink layers applied thereto.

In the ink paper cassette 3, as shown in FIG. 3 which is a perspective view of the cassette, and FIG. 4(*a*) which is a plan view of an ink paper or FIG. 4(*b*) which is a plan view of another ink paper, there is contained in a wound-up state either an ordinary ink paper 5*e* comprising a base film as well as inks of three colors—yellow (Y) 5*a*, magenta (M) 5*b* and cyan (C) 5*c* and an ink marker 5*d* which are applied successively as inked surfaces onto the base film, or an ink paper 5*g* for ordinary paper having a receiving layer 5*f* disposed in front of ink layers (the arrow shown in the figure indicates a traveling direction). In the case where the ink paper contained in the ink paper cassette 3 is the ordinary ink paper 5*e*, an ink discrimination mark 27 capable of being detected by a photointerrupter 39 which is constituted by a combination of a light emitting element and a light receiving element, is provided on a side face of the cassette. The discrimination mark 27 of the ink cassette 3 serves as a discrimination mark for the selection of a recording paper, but the discrimination mark may be used for the selection of an ink paper cassette. The receiving layer 5*f* formed on the ink paper 5*g* for ordinary paper is of the same composition as that of a special recording paper having a receiving layer already formed thereon.

The ink paper 5 is constituted so that the light from the light emitting element 24 does not pass only the ink marker 5*d*, but passes the other portion as well.

A chuck arm 28 which urges a front end of the recording paper 12 to the surface of the platen roller 1 continually during recording is constructed in such a manner that it is pressed against the outer periphery of the platen roller 1 by means of a pair of springs 29 which are mounted in a U shape through the shaft 2, and that the urging force is released by means of a K arm 31 which is mounted to a chassis (not shown) pivotably about a fulcrum 30 and which is driven by a drive member (not shown). Further, the chuck arm 28 is constructed so as to be held in a predetermined position while it presses the outer periphery of the platen roller 1, and so as to be pivotable about the shaft 2 when the pressing force is released by the K arm 31.

Numeral 32 denotes a feed-side guide for the ink paper cassette 3, partially constituting a guide portion during conveyance of the recording paper 12.

Numeral 33 denotes a guide for conveyance of the recording paper 12, with a sensor 34 being attached thereto, which sensor judges whether the recording paper 12 has been fed or not during the feed of paper and controls the amount of the paper to be conveyed so as to be chucked in a predetermined position by the chuck arm 28.

Numeral 35 denotes a take-up-side guide for the ink paper cassette 3. The guide 35 is provided with a discharge port 35*a* for discharge of the recording paper 12 and is formed with a guide portion for guiding the recording paper 12 during paper feed and during conveyance with the platen roller 1. The guide 35 is further provided with an engaging portion 35*b* for engagement between the guide 35 and the chuck arm 28 when the chuck arm 28 is pushed up by the platen roller 1. The feed-side guide 32, conveyance guide 33 and take-up-side guide 35 are each fixed to a chassis (not shown).

Above the feed roller 7, a discharge roller 36 is mounted to a bracket (not shown) so that it can rotate and come into pressure contact with the feed roller 7 at a predetermined pressing force.

Numerals 37 and 38 represent discharge guides for the recording paper 12, each fixed to a chassis (not shown).

(2) Operation of the apparatus (Thermal Transfer Recording Method)

Figure 6:
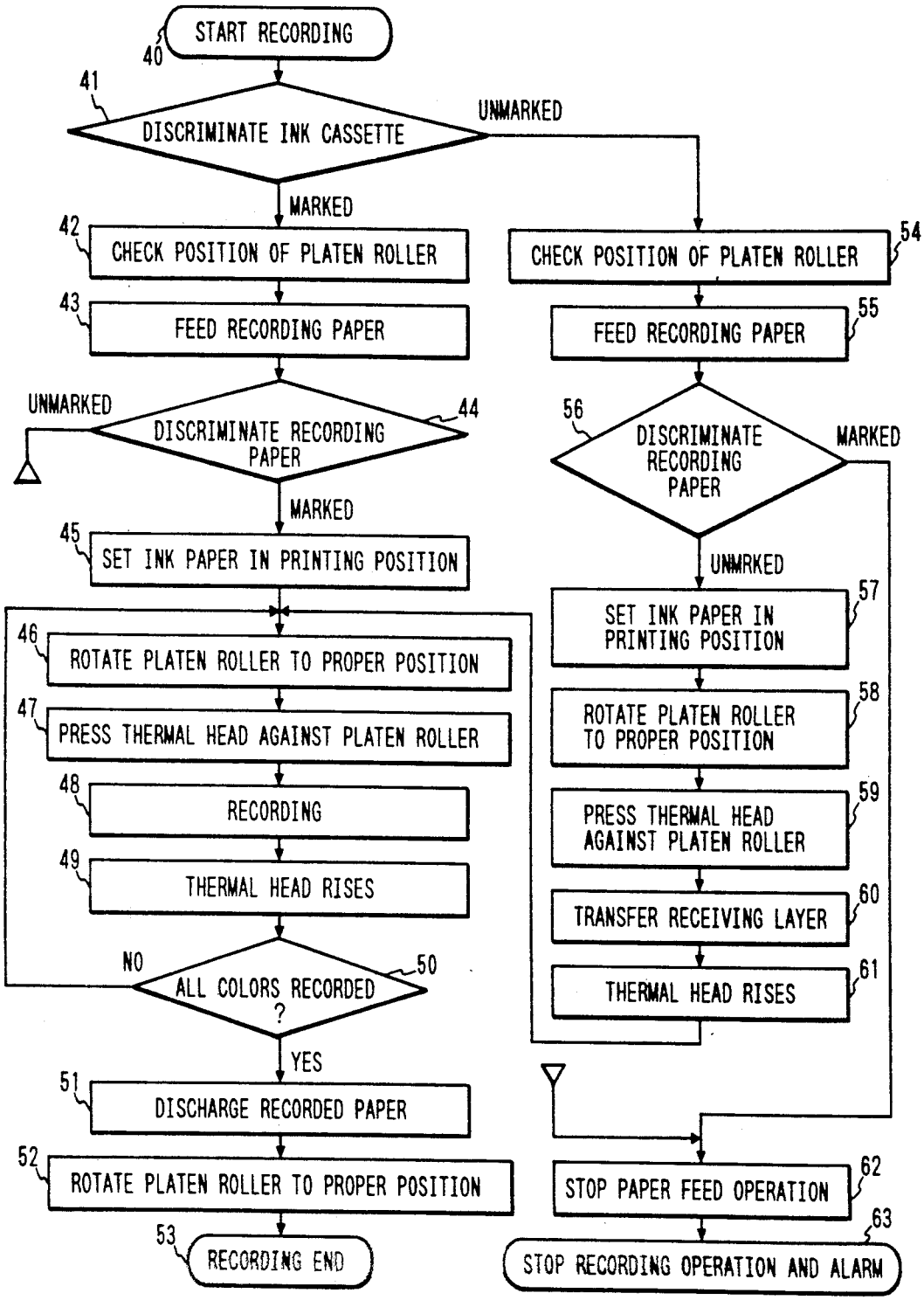
FIG. 6 is a flowchart showing the operation of the thermal transfer recording apparatus illustrated in FIGS. 1 and 2.

The flowchart of FIG. 6 shows in what procedure the thermal transfer recording apparatus described above operates. The operation of the apparatus and the thermal transfer recording method of the invention will be described below step by step in accordance with the flowchart. In the following description, each head numeral indicates a step.

40: A recording start instruction is issued by pushing a print switch (not shown) and recording is started. At this time, the thermal head 21 is in its solid line position shown in FIG. 1, and the chuck arm 28 is spaced a predetermined distance from the outer periphery of the platen roller 1, namely, it is held in a state waiting for the recording paper 12, by means of the K arm 13. (This state will hereinafter be referred to as the "initial state.")

41: In accordance with a recording start instruction, the photointerrupter 39 detects whether the ink discrimination mark 27 of the ink paper cassette 3 is present or not, and if the mark is present, the operation is changed over to step 42, while if the mark is not present, the operation is changed over to step 54.

42: Before starting the operation for feeding the recording paper 12, it is checked whether the platen roller 1 and the chuck arm 28 are in predetermined proper positions or not, using detector means (not shown), and if the answer is negative, both components are rotated up to the predetermined positions.

43: Recording papers 12 on the recording paper tray 13 are driven in the arrowed direction in FIG. 1 by means of a drive member (not shown) and are brought into pressure contact with the pickup roller 6 at a predetermined urging force, while the separating roller 10 is also contacted under pressure with the feed roller 7 at a predetermined pressing force. Then the pickup roller 6 is rotated counterclockwise by means of a drive source (not shown), whereby the recording papers 12 are fed into the apparatus.

44: While the recording papers are conveyed by the pickup roller 6, the discrimination marks 12*a* (see FIG. 5) of the recording papers 12 are read by the paper marker sensor 26. In the case where the discrimination marks 12*a* are detected, it follows that the recording papers are special recording papers, so the recording operation is continued, while when the marks 12*a* are not detected, it follows that the recording papers are ordinary papers not having a receiving layer, so the operation proceeds to step 62. As the recording operation is continued, the recording papers 12 are separated into individual recording papers by the separating roller 10, which papers are then conveyed to a predetermined position of the chuck arm 28 by means of the feed roller 7 while being guided by the conveyance guide 33, and then held under pressure, whereby the feed operation for the recording paper 12 is completed and the separating roller 10 is moved out of pressure contact with the feed roller 7.

45: The head arms 20 are driven up to the dotted line position shown in FIG. 1 by means of the cam gear 14 At the same time, the ink marker 5*d* is detected by the light emitting element 24 and the light receiving element 25 while the ink bobbin 4 is rotated by a drive source (not shown), and the ink paper 5 (5*e*) is set in the printing position.

46: The platen roller 1 which holds the recording paper 12 under pressure is rotated up to its position shown in FIG. 2 by means of a drive source (not shown) while the position thereof is controlled by the foregoing detector means. At this time, the ink paper 5 holds its state.

47: The head arms 20 are driven up to the position shown in FIG. 2 by the cam gear 14, and the thermal head 21 is brought into pressure contact with the platen roller 1 at a predetermined pressing force through the ink paper 5. At this time, the recording paper 12 is held under pressure by the chuck arm 28.

48: The platen roller 1 is rotated counterclockwise and electric power is supplied to the thermal head 21, whereby the first color, yellow, is recorded over a predetermined range. While the ink paper 5 is driven together with the recording paper 12 by means of the platen roller 1 and the thermal head 21, the recorded portion is wound round the take-up side ink bobbin 4 under a predetermined tension.

49: When the recording of a predetermined range is over, the thermal head 21 is raised up to its dotted line position shown in FIG. 1 by the cam gear 14. The size of the ink paper 5 is set so that the magenta ink portion of the second color has already been set in the printing position by that time.

50: The recording of magenta and cyan are also performed by repeating the operations of steps 46 to 49.

Figure 2:
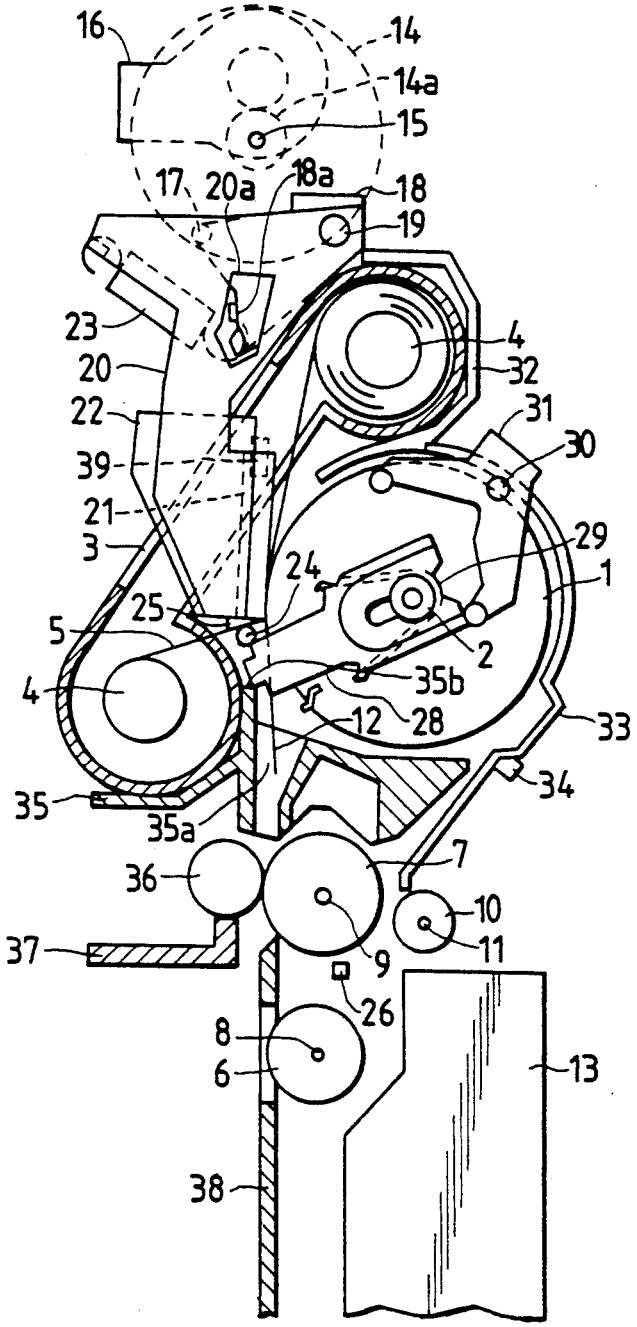

51: When the recording of cyan is over, the platen roller 1 is rotated in the counterclockwise direction and the thermal head 21 is again brought into pressure contact with the platen roller 1. At the same time, the K arm 31 is rotated in the clockwise direction to release the pressure-held state of the recording paper 12 by the chuck arm 28. This released state is shown in FIG. 2. Thereafter, the platen roller 1 is again rotated counterclockwise, whereby the recording paper 12 is conducted to the discharge port 35*a* through the gap between the platen roller 1 and the chuck arm 28, and is discharged while being guided by the discharge guides 37 and 38. The chuck arm 28 abuts the engaging portion 35*b* and continues to maintain the state shown in FIG. 2. With the discharge operation, the ink paper 5 is also driven, but the size of the cyan ink portion is set to a value not causing any problem. When the recording paper 12 has been conveyed up to the discharge roller 36 and feed roller 7, the thermal head 21 returns to the position of the initial state and thereafter the conveyance is continued by the feed roller 7.

52: When the platen roller 1 is again rotated up to its state shown in FIG. 2, the K arm 31 is rotated counterclockwise and the chuck arm K is again brought into pressure contact with the platen roller 1 by means of the springs 29. Thereafter, the platen roller 1 is rotated counterclockwise up to the position of the initial state.

53: Through the above operations, the recording to the recording paper is over, and preparations for starting the next recording are completed.

Figure 4B:
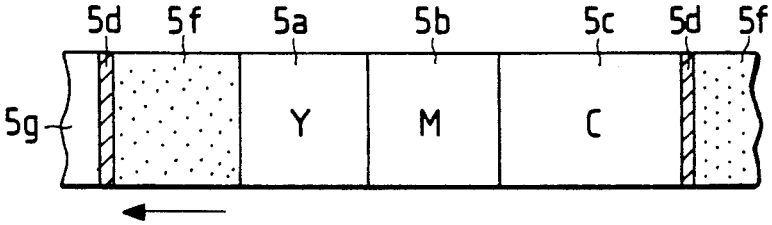

In the case where the discrimination mark 27 of the ink paper cassette 3 is not detected in step 41, that is, when the ink paper cassette 5*g* shown in FIG. 4(b) is selected, the operation flow shifts to steps 54 et seq. In the same manner as in steps 42 to 47, the operations from step 54 to step 59 are performed. In step 56, however, the recording operation is continued when the discrimination mark 12*a* is not detected, that is, when the recording paper is judged to be a recording paper not having a receiving layer, while if the discrimination mark is not detected, the flow proceeds to step 62.

60: The platen roller 1 is rotated counterclockwise and electric power is supplied to the thermal head 21, whereby the first receiving layer 5*f* is recorded at least in a base area where images are to be printed thereafter. At this time, energy necessary for transferring the receiving layer 5*g* to the recording paper 12 is fed to the thermal head 21 and, like step 48, the recorded portion is wound round the take-up side ink bobbin 4 under a predetermined tension while the ink paper 5 (5*g*) is driven together with the recording paper 12 by means of the platen roller 1 and the thermal head 21.

61: When the recording of a predetermined range is over, the thermal head 21 is raised up to its dotted line position shown in FIG. 1 by the cam gear 14. The size of the ink paper 5 is set so that the yellow ink portion of the first color has already been set in the printing position by that time.

When the transfer of the receiving layer to the recording paper 12 is over in step 61, the operation for the transfer of ink is performed in the same manner as in steps 46 to 53.

62: Since the recording paper does not match the loaded ink paper cassette 3, the paper feed operation is discontinued and the pickup roller 6 is rotated clockwise to return the recording paper 12 onto the recording paper tray 13.

63: The apparatus reverts to the initial state and it is indicated that the recording paper does not match the user, using a lamp or an indicator panel for example.

Through the operations, the mark of the ink paper cassette loaded is discriminated, then a proper recording paper is selected, and a thermal transfer recording with exact colors is effected.

According to the above embodiment, a discriminative portion for detecting the type of an ink paper cassette which has been loaded into the apparatus is read, then a control is made to change over between printing operations, and a check is made to see if the recording paper to be fed matches the loaded ink paper cassette, whereby there can be provided a thermal transfer recording apparatus capable of affording a high quality print equal to that obtained using a recording paper having a receiving layer, even with respect to a recording paper not having a receiving layer such as a postal card for example.

We claim:

1. A thermal transfer recording method for recording on a recording paper using ink paper contained in an ink paper cassette, said ink paper having ink layers, and said ink paper cassette further containing an ink paper feeding bobbin with the ink paper wound therearound, and a take-up bobbin for taking up the ink paper fed from the feed bobbin, a recording paper, a platen roller, and a thermal head, said recording paper and said ink paper fed from said feed bobbin being disposed in a superimposed manner on said platen roller and urged toward the platen roller from the ink paper side and heated by said thermal head, thereby allowing ink to be transferred from the ink paper to the recording paper in accordance with information provided to the thermal head, said method comprising the steps of:

discriminating whether the ink paper cassette is of a first ink paper cassette type containing a first ink paper having only ink layers, or of a second ink paper cassette type containing a second ink paper having both a receiving layer and ink layers;

selecting a first recording paper having a receiving layer if the discriminated ink paper cassette is of the first ink paper cassette type, or selecting a second recording paper not having a receiving layer if the ink paper cassette is of the second ink paper cassette type; and transferring ink to the selected recording paper from the ink paper contained in said discriminated ink paper cassette.

2. A method according to claim 1, wherein at least one of said first and second ink paper cassettes is provided with a mark for discrimination, and the discriminating step is carried out by detecting said mark.

3. A method according to claim 1, wherein at least one of said first and second recording papers is provided with a mark for discrimination, and the selecting step is carried out on the basis of detection of said mark.

4. A method according to claim 2, wherein at least one of said first and second recording papers is provided with a mark for discrimination, and the selecting step is carried out on the basis of detection of said mark.

5. A thermal transfer recording apparatus which has an ink paper cassette containing an ink paper having ink layers, also containing an ink paper feed bobbin with the ink paper wound therearound, and further containing a take-up bobbin for taking up the ink paper fed from the feed bobbin, a platen roller, and a thermal head, and in which a recording paper and the ink paper fed from said feed bobbin are disposed in a superimposed manner on said platen roller and are urged toward the platen roller from the ink paper side and heated by said thermal head, thereby allowing ink to be transferred from the ink paper to the recording paper in accordance with information provided to the thermal head, said apparatus comprising a discriminator means for discriminating whether the ink paper cassette is of a first ink paper cassette type containing a first ink paper having only ink layers, or of a second ink paper cassette type containing a second ink paper having both a receiving layer and ink layers; and a selecting means for selecting a first recording paper having a receiving layer if the discriminated ink paper cassette is of the first ink paper cassette type or selecting a second recording paper not having a receiving layer if the discriminated ink paper cassette is of the second ink paper cassette type;

wherein ink is transferred to the selected recording paper from the ink paper contained in said discriminated ink paper cassette.

6. An apparatus according to claim 5, wherein at least one of said first and second ink paper cassettes has a mark for discrimination, and the discriminator means discriminates between the first and second ink paper cassettes by detecting said mark.

7. An apparatus according to claim 5, wherein at least one of said first and second recording papers has a mark for discrimination, and said selecting means selects either the first or the second recording paper on the basis of detection of said mark.

8. An apparatus according to claim 6, wherein at least one of said first and second recording papers has a mark for discrimination, and said selecting means selects either the first or the second recording paper on the basis of detection of said mark.

* * * * *